US006684607B2

(12) United States Patent
Ng et al.

(10) Patent No.: US 6,684,607 B2
(45) Date of Patent: Feb. 3, 2004

(54) METHOD AND ASSEMBLY FOR WASHING WARES FOR FOOD AND FILLING WARES WITH FOOD

(75) Inventors: Martin B. H. Ng, Richmond Hill (CA); Peter R. Simon, Mississauga (CA); Fred W. Cress, Mississauga (CA); Anthony G. DiMarco, Woodbridge (CA); Ardem M. Peltekian, Toronto (CA); Philip L. Thompson, Brampton (CA); Jose E. Almeida, Mississauga (CA); Rose R. Campbell, Mississauga (CA); Ronald Jagroop, Brampton (CA); Darcy J. Hawkins, Pointe Claire (CA)

(73) Assignee: Cara Operations Limited, Mississauga (CA)

( * ) Notice: Subject to any disclaimer, the term of this patent is extended or adjusted under 35 U.S.C. 154(b) by 0 days.

(21) Appl. No.: 10/141,787

(22) Filed: May 10, 2002

(65) Prior Publication Data

US 2003/0029139 A1 Feb. 13, 2003

Related U.S. Application Data

(63) Continuation-in-part of application No. 09/845,191, filed on May 1, 2001, now abandoned, which is a continuation of application No. 09/049,082, filed on Mar. 27, 1998, now Pat. No. 6,223,502.

(51) Int. Cl.[7] ..... B65B 55/04

(52) U.S. Cl. ..... 53/426; 53/167

(58) Field of Search ..... 53/426, 443, 473, 53/141, 167, 235; 134/25.2, 48, 56 D, 58 D; 422/26, 28

(56) References Cited

U.S. PATENT DOCUMENTS

| | | | | |
|---|---|---|---|---|
| 3,058,276 | A | 10/1962 | Palma | |
| 3,122,235 | A | 2/1964 | Meeker et al. | |
| 3,960,290 | A | 6/1976 | Yake et al. | |
| 4,349,508 | A | 9/1982 | Liede | |
| 5,201,826 | A | 4/1993 | Zimmermann | |
| 5,377,475 | A | 1/1995 | Haarer et al. | |
| 6,223,502 | B1 * | 5/2001 | Cress et al. | 53/426 |

FOREIGN PATENT DOCUMENTS

| | | |
|---|---|---|
| DE | 1403654 | 9/1970 |
| DE | 4339111 | 5/1994 |
| FR | 71.45842 | 10/1972 |
| WO | WO 96/01584 | 1/1996 |
| WO | WO 98/04180 | 2/1998 |

* cited by examiner

*Primary Examiner*—Stephen F. Gerrity
(74) *Attorney, Agent, or Firm*—Bereskin & Parr

(57) ABSTRACT

A method and assembly are provided for cleaning and refilling wares for delivering food, e.g. trays, plates, bowls and cutlery, as might be used on airlines and in the health care industry. The wares are provided in sets and kept together in sets. After washing of each set, it is cooled if necessary and is allocated to one of a plurality of distinct refilling lines for refilling and reuse. This can be achieved by providing a conveyor line along which are arranged a washer, dryer and cooling unit to keep the wares together, and a refilling station downstream of the conveyor. The invention provides a basket including a base portion and a frame portion. The frame portion is insertable into the base portion, and may be replaced by other frames to accommodate different sets of wares. Separate lines can be provided for galley and business class wares, and, simultaneously, commissary carts can be replenished in a separate area.

38 Claims, 14 Drawing Sheets

METHOD AND ASSEMBLY FOR WASHING WARES FOR FOOD AND FILLING WARES WITH FOOD

CROSS REFERENCE TO RELATED APPLICATIONS

This application is a Continuation-in-Part of earlier application Ser. No. 09/845,191 filed May 1, 2001, now abandoned which in turn is a Continuation of earlier application Ser. No. 09/049,082 filed Mar. 27, 1998, now U.S. Pat. No. 6,223,502.

FIELD OF THE INVENTION

This invention relates to an assembly and a method for cleaning soiled food containers, utensils, trays etc., and for enabling a tray to be assembled with a required complement of wares, e.g. bowls or other food containers and utensils and filling the containers with food. This invention has applicability in any large institution or organization including airlines, hospitals, other health care institutions and the like.

BACKGROUND OF THE INVENTION

It has long been known to provide meals for aircraft passengers, by preparing the food in a ground facility or kitchen, and for each passenger, assembling a tray comprising the necessary bowls, plates, utensils with the food already placed in the bowls etc. This is done for the simple reason that the compact space and weight limitations of aircraft simply do not permit of anything beyond simple reheating and serving of food. Accordingly, much expertise has been developed in promptly assembling meals in this manner, even in relatively large quantities, and arranging for their delivery immediately prior to the departure of flight, to ensure that the food is relatively fresh.

Many large institutions have also had a requirement to prepare meals or food in large quantities, and arrange, in effect, for each meal to be delivered individually to a person. This commonly arises in hospitals and Institutions caring for elderly people. Traditionally, such institutions would have a kitchen on site, and the meals would be prepared, and delivered from the kitchen immediately by a cart or cart to the patients.

More recently, for such institutions, it has been recognized that there are advantages to preparing meals or food in a more systematic way, possibly even using an external facility, so that the food is then prepared and delivered in a manner analogous to the preparation and delivery of airline meals. Equipment has been developed which enables trays to be loaded with some food which is to be served warm, e.g. a traditional hot meal, and other items e.g. dairy products, which are to be kept cold. Such trays are provided with a central divider, separating the tray into two halves. Such trays are then loaded into a special container or cart which is provided with ducting, so that one side of each tray can be chilled with cold air, and immediately prior to handing out the trays to the individuals, the other side of each tray has warm or hot air passed over it to reheat or rethermalize the food on that side.

However, a fundamental problem with any such technique is the handling of the wares, and in this specification including the claims, the term "wares" encompasses trays, plates, bowls, cups, utensils and any other reusable items necessary to deliver food and beverage. There is the problem of assembling the wares to make up complete or loaded trays and the handling of soiled, returned wares. The traditional approach, used by flight kitchens for airlines and the like is to treat the two operations of cleaning soiled wares and preparing fresh trays as entirely separate.

Thus, a conventional kitchen, for preparing of airline meals, soiled trays etc., are commonly received in standard carts. These are unloaded, and the individual wares, i.e. trays, bowls, cups, knives and forks are separated and placed on a conveyor, which takes them through a large washing and drying unit, where the wares are washed and dried. At the exit from this unit, the individual items are collected, stacked and placed in separate storage. Usually, the wares are quite warm as a result of the washing and drying process, but this is not a disadvantage where the wares are placed in storage, and indeed there may even be benefits in driving off any remaining moisture.

Here, it should be born in mind that each airline usually has their own line of crockery or utensils, bearing the airline's insignia. Consequently in these kitchens, there is the need to handle a wide variety of different bowls, plates and other wares, and to keep these separate. Also, even for any one airline, there is usually a difference between the wares used for tourists or ordinary class passengers and that used in business or first class, which again increases the number of different types of wares that have to be stored and handled. Thus, it is common for a flight kitchen to have a relatively large storage area where all of the different types of wares etc. are stored.

When it is desired to prepare food for a particular flight, the appropriate trays, crockery and other wares are pulled from storage, and delivered to a separate section of the flight kitchen. There, individual trays are made up, commonly comprising a tray, a number of bowls, cups, cutlery and condiments. The cutlery may either be reusable, commonly stainless steel cutlery or disposable plastic cutlery. In either case, it is common for the necessary items of cutlery to be separately packaged, often with individual packets of condiments and the like, or enclosed in a plastic bag. As a matter of convenience in assembling the tray, the bag containing these various items is often placed on the tray at the end of the assembly process. The tray with the bowls is passed along a conveyor belt or line, and the individual food items are placed on it sequentially, both to enable the trays to be assembled quickly, and to ensure consistency and uniformity.

Depending upon the exact timing, the completed trays may be dispatched immediately from delivery to an aircraft, or alternatively may be held in a large, refrigerated storage facility. It should also be born in mind that passengers often have requirements for specific meals, to meet dietary requirements, religious laws and the like. These, usually, must be prepared individually, and then stored with the main part of the shipment, for delivery to the individual aircraft.

Generally similar techniques are used, when preparing food for hospitals and other institutions. The main difference is that, for airline use, the trays, bowls etc. are often quite compact, and airline passengers recognize and accept that compact equipment has to be used in the confined space of an aircraft On the other hand, wares for use in hospitals and the like are usually or more conventional dimensions, so as to be significantly larger than those found on aircraft. This, in turn, creates complexity if a kitchen is to be conFIg.d to handle all types of wares. As noted, it is also becoming more common, for such institutional use, to provide trays, which often will be much larger than airline trays, with a central divider separating the tray into two parts, to enable both hot and cold food to be delivered simultaneously.

SUMMARY OF THE INVENTION

Accordingly, the inventors of the present invention have recognized that it is desirable to provide a more streamlined and efficient way of handling these wares. More particularly, the present inventors have realized that it is desirable to break the handling of the wares down into distinct parallel lines in order to permit greater specialization and focus on the specific wares, and to save time in reassembling the wares.

In accordance with a first aspect of the present invention, there is provided an assembly for washing soiled wares and providing the wares for refilling and reuse, the assembly comprising:

a sorter station for receiving soiled wares to an for sorting the wares into baskets:

a discharge station for removing clean wares from the baskets and reassembling wares into sets of wares;

a substantially continuous conveyor means extending between the sorter station and the discharge station and back from the discharge station to the input station, for conveying baskets with wares, a washing and drying means provides on the conveyor means;

a cooling means provided on the conveyor means; and a refilling station, at the discharge station, for refilling the wares, the refilling station having a plurality of distinct refilling lines for refilling the wares, the wares being directable to any one of the distinct refilling lines;

wherein the input station, conveyor means, washing and drying means, and cooling means are arranged such that baskets containing sets of wares are sequentially subject to washing, drying and cooling between the input and discharge stations.

In accordance with another aspect of the present invention, there is provided an assembly for washing soiled wares and providing the wares fir refilling in use, the assembly comprising:

a first line for receiving soiled wales, washing soiled wares, drying washed wares, refilling the wares providing refilled wares on trays and stocking the trays in first carts;

a second line for washing the first carts for the wares; and a commissary zone for at least restocking second carts with commissary goods.

Advantageously, each of the plurality of refilling lines is for refilling the wares with different contents. To enable greater throughput, some of the refilling lines preferably comprise two refiller locations on either side of a conveyor.

A third aspect of the present invention provides a method of washing wares for food an filling the wares with food, the method comprising:

(a) receiving sets of soiled wares, each set comprising a plurality of wares intended to be used together for one individual;

(b) passing the wares through a washing and drying means, in which the wares are washed and dried;

(c) ensuring that the wares ate cooled down to a temperature low enough to permit immediate refilling of the wares with food;

(d) dividing the wares based on food to be filled on the wares;

(e) reassembling the wares into sets; and (f) refilling the wares with food, whereby each set is ready for delivery to an individual;

wherein steps (a) to (c) are carried out substantially sequentially, and steps (a) to (f) are carried out substantially continuously.

further aspect of the present invention provides a basket for conveying at least one set of wares, including a tray and containers for food, the basket having a generally open structure to permit free flow of water and air, and the basket comprising:

a base portion for supporting the basket on a conveyor; and a frame for holding a set of wares;

wherein the frame is insertable onto the base portion, and may be changed to accommodate different sets of wares.

Preferably, the basket includes frame attachment means for attaching the frame to the base portion.

BRIEF DESCRIPTION OF THE DRAWINGS

For a better understanding of the present invention, and to show more clearly how it may be carried into effect, reference will now be made, by way of example, to the accompanying drawings, which show a preferred embodiment of the present invention, and in which.

DETAILED DESCRIPTION OF THE PREFERRED EMBODIMENTS

Figure 1:
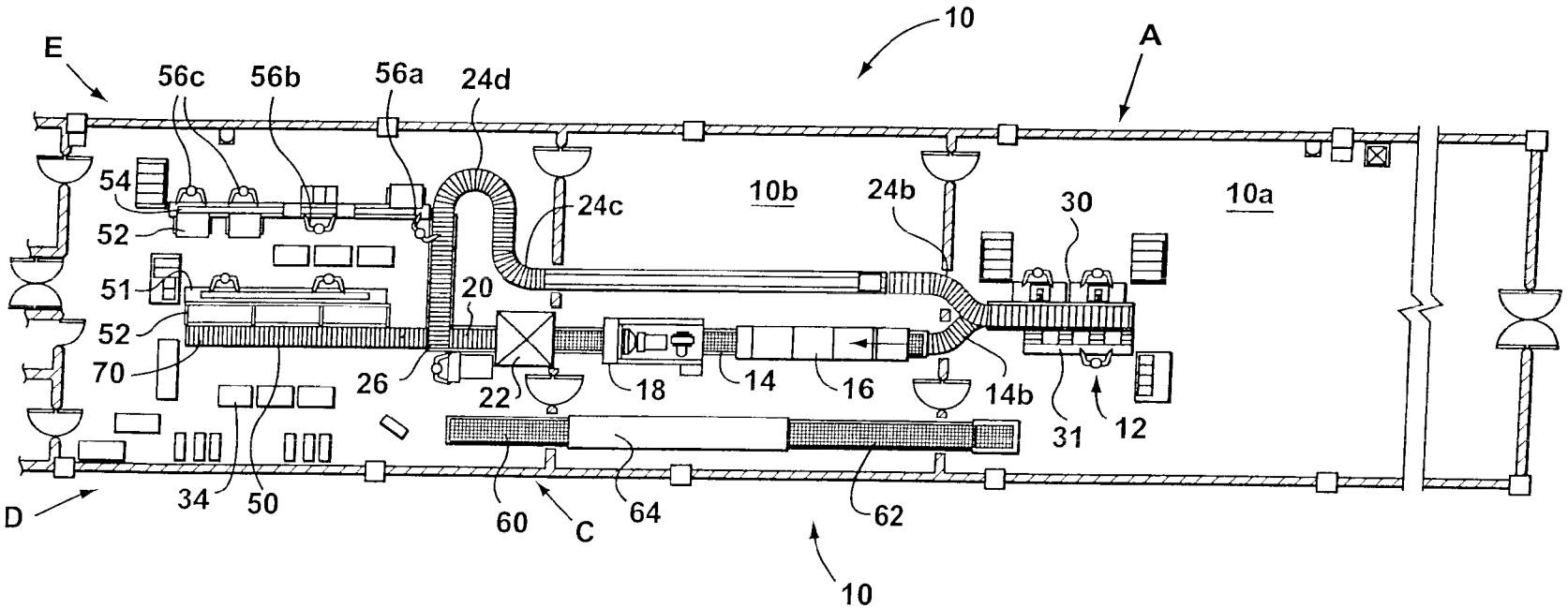
FIG. 1 is a plan view of an assembly in accordance with the present invention.

Referring first to FIG. 1, an assembly in accordance with the present invention is indicated generally by the reference 10. The assembly 10 has a sorter station 12. Extending from the sorter station 12 is a first conveyor 14, and located around and enclosing a portion of the first conveyor 14 are a washing unit 16 and a drying unit 18. At the end of the first conveyor 14, there is a second conveyor 20, and a cooling unit 22 that is located on and around the second conveyor 20. A third or return conveyor 24, for purposes to be described, extends from the end of the second conveyor, back to the sorter station 12. A discharge station 26 is provided at the junction between the second and third conveyors 20, 24 and along the first, straight part of the third or return conveyor 24.

As indicated in FIG. 1, the assembly 10 is located in three adjoining rooms:

all inbound, soil room 10*a*, in which dirty or soiled wares and carts are received;

a washing or machine room 10*b*; and a clean, assembly room 10*c*.

The sorter station 12 is located in the inbound, soil room 10*a*. From there, the first conveyor 14 extends into the machine room 10*b* and the clean, assembly room 10*c*. The machine room 10*b* includes the washing unit 16 and drying unit 18, and for this reason is also known as a machine room. The clean assembly room includes the drying unit 22, as well as the discharge station 26. Separation of the assembly into three rooms helps to control the flow of wares, such that dirty wares are less likely to be inadvertently mixed with the clean wares, or clean wares mixed with dirty wares.

Separation of the system into three rooms also provides an advantageous and natural separation into rooms maintained at different temperatures. Thus, the machine room 10*b* includes the washing and drying units 16, 18 that necessarily operate at high temperatures, and consequently this will be relatively warm. The inbound, soil room 10*a* is preferably, although not essentially, maintained cooled or refrigerated, since it will frequently hold for some period of time trolleys or carts filled with soiled wares. Keeping the room 10*a* cooled limits growth of bacteria and thus reduces undesirable odours. The clean, assembly room 10*c* is similarly chilled or refrigerated, to maintain fresh food located there, placed on wares, and stored on completed trays.

Parallel to the first conveyor 14 is a cart conveyor 62. The cart conveyor 62 receives dirty carts 34 in room 10*a*, and from there conveys them to a cart washing unit 64' in room 10*b*. The cart conveyor 62, which can be of conventional design, then conveys the carts 34 into the loading room 10*c*, where the carts can be offloaded for loading It is here noted that, for consistency, the term 'cart' is used throughout this specification, to denote a simple wheeled vehicle, for holding trays, that can be manually moved as required. The term 'trolley' is, at least some countries, used by airlines as an alternative term.

Figure 2:
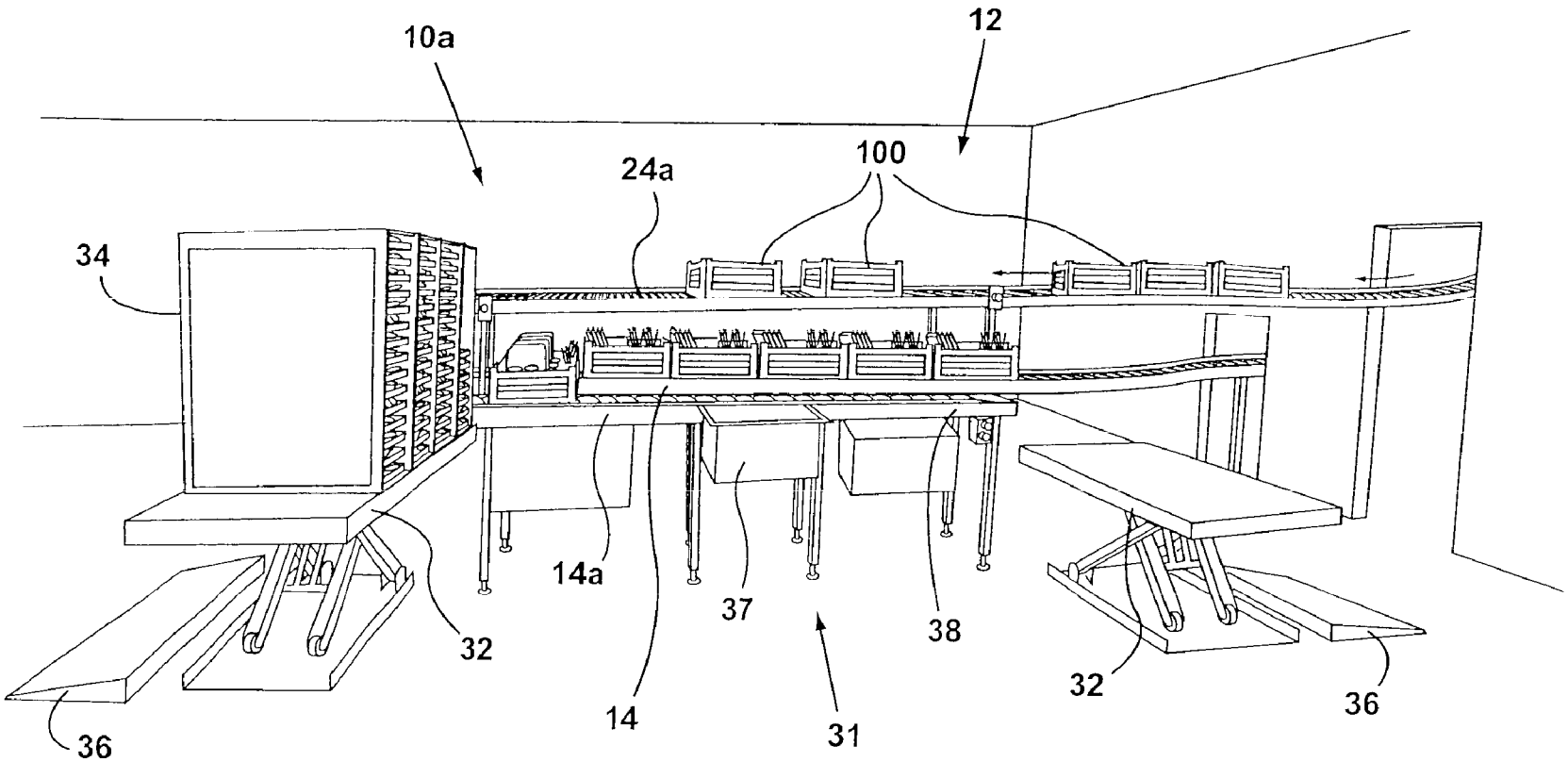
FIG. 2 is a perspective view, in the direction of the arrow A of FIG. 1, showing an input station of the assembly.

Turning to details of the sorter station 12, this is best seen in FIG. 2. The sorter station 12 has two separate locations 30 and 31 (shown in FIG. 1), which are symmetrical on either side of the conveyor 14, and for simplicity are described in relation to the input location 30. The first conveyor 14 has a lower input end 14*a*, and the third conveyor 24*a* has an upper return end 24*a*, located parallel and above the input end 14*a*, for reasons explained below. To accommodate the stacked parallel relationship of the input and return ends 14*a*, 24*a*, the conveyors 14, 24 additionally includes curved sections 14*b*, 24*b*, each including both a left hand and a right hand curve, joining the conveyor ends 14*a*, 24*a* to parallel sections of the conveyors 14, 24. The provision of two input locations 30, 31 enables two or more operators to work simultaneously, to provide faster loading of the conveyor 14, as detailed below.

The input location 30 is provided with at least one scissors lift 32 for conventional carts 34. These carts 34 can be any suitable cart with the scissors lift 32 being dimensioned accordingly. Commonly, for airline use, the carts 34 will be standard carts as found on airlines, for holding food trays and dispensing them to passengers. A ramp 36 is provided to enable the carts 34 to be rolled on top of the scissors lift 32, when in a lowered position. The lift 32 then enables an individual cart 34 to be raised to a comfortable working position, so that trays can be readily accessed. Where required, for non "pass through" carts, rotating lifts can be provided.

For the left hand side of the location 30 (as viewed in FIG. 2), an input table 38 is provided, which would be immediately in front of the operator, so that the operator would then have the lift 32 and a cart on his or her left.

The sorter table 38 provides a surface for supporting a basket 100 facing the operator, and as shown in FIG. 2 at the left hand end of the sorter table 12, a basket 100 can be placed on the sorter table 12 inclined towards the operator for ease of loading. The basket 100 is an important aspect of the present invention, and enables one or more complete set of wares, i.e. a tray, plates, bowls, cups, cutlery etc to be maintained together. The basket and its mode of use are described in detail below. For the time being, it is sufficient to note that the returned, soiled wares are loaded into the basket 100, for transportation through the washing and drying unit 16 and 18 and then through the cooling unit 22. The sorter table 38 also provides a location for placing a tray, while the tray and its wares are sorted and loaded into a basket 100. The center of the sorter station 12 provides for deposit of food waste, napkins, etc. and is connected to a device for withdrawing this waste to a waste collection container.

The upper return end 24*a* is provided, to ensure that returned empty baskets 100 are provided at a convenient and ergonomically efficient height for the operator. The baskets 100 do not then have to be lifted up any significant distance. Rather, each basket 100 need simply be lifted slightly over the edge of the upper, return end 24*a*, slid off the return end 24*a* and then placed on the sorter table 38. Additionally, as the return end 24*a* is directly above the input end 14*a*, both sides of the return end 24*a* are available to the operator. This means it is equally easy to remove a basket from the return end 24*a*, from either side of the sorter station 12 As is explained in greater detail below, a resultant advantage is that up to four operators at a time, two on each side, could work at the locations 30, 31 of station 12, giving a higher throughput of baskets 100 and wares to be cleaned.

Figure 7:
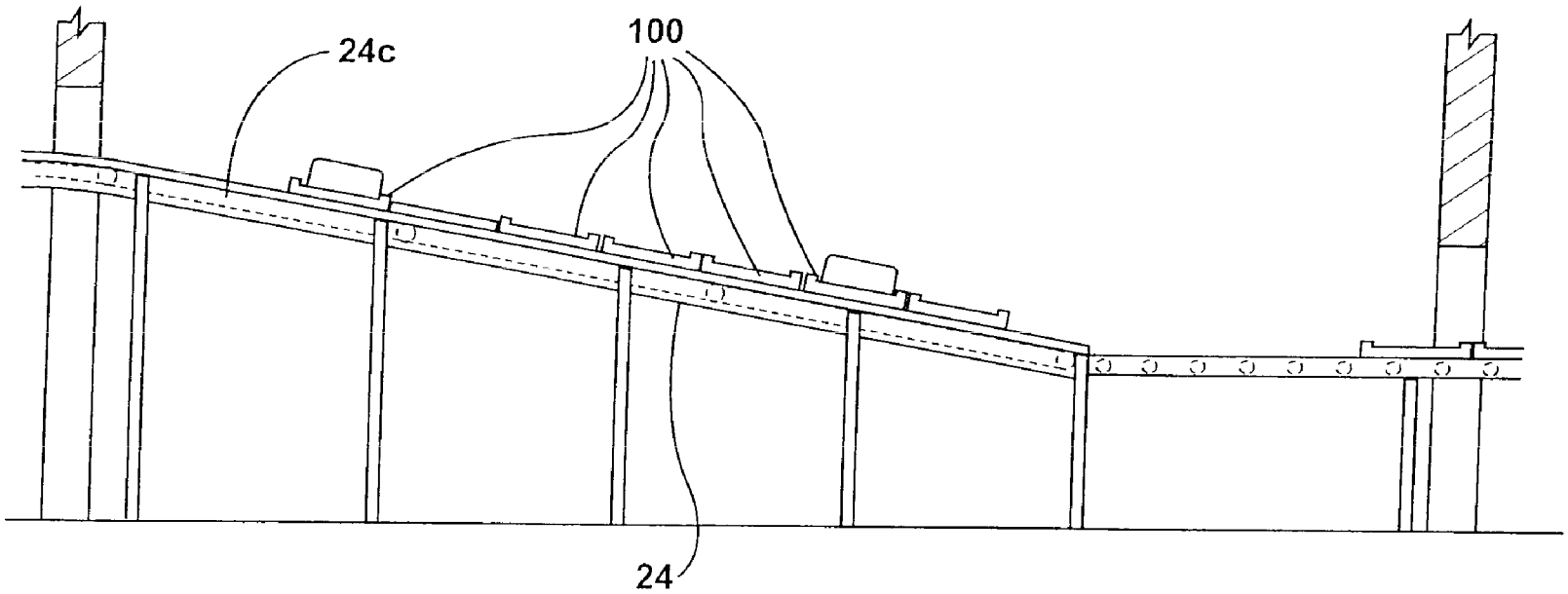
FIG. 7 is a side view of a first conveyor of the assembly of FIG. 1.

As noted, for ergonomic reasons, it is preferable that the return end 24*a* of the conveyor 14 be elevated. Specifically, baskets at that height can be more readily lifted and moved, as it is not necessary to stoop to lift the basket. Referring to FIG. 7, the return or third conveyor 24 in the machine room 10*b* is shown. The conveyor 24 includes an inclined section 24*c* that raises the baskets 100 to the height required for the return end 24*b* to make it easier for the workers or operators to remove them.

The inclined portion 24*c* can be provided with a different drive mechanism, e.g. a belt, to ensure baskets do not slip back down the inclined portion 24*c*, the top of the inclined portion 24*c* is slightly higher than the return end 24*b*. This then enables the return end 24*b* to be provided with idler rollers, that are not driven, and the momentum of the baskets 100 carries them along the return end 24*b*.

For the location 30, a soaker sink 37 is provided, which would be immediately to one side of the operator, and is shared between two operators. In some cases, food debris will have hardened onto the wares. In order to facilitate removal of the debris, the wares may be soaked in the soaker sink 37 for a period of time sufficient to loosen the debris so that wasting of the wares is facilitated.

Once the basket 100 has been loaded, it is placed on the conveyor 14. The conveyor 14 then conveys the baskets 100 containing the soiled wares into the washing unit 16. It is here noted that the washing and drying unit 16, 18, the cooling unit 22 and associated conveyors can, individually, be conventional items of equipment, as found in commerical or industrial scale kitchens, and generally in accordance with earlier U.S. Pat. No. 6,223,502. Thus, for each installation, appropriate washing units etc can be chosen and, depending upon the space available, appropriate conveyors or the like can be selected to connect the individual units together, to enable continuous and automatic handling of the baskets 100. Typically, the conveyors each comprise a series of rollers with a drive connection to each roller. The drive connection can be a series of chain drives between adjacent pairs of rollers. Additionally, clutches are provided in the rollers, so that in effect a constant torque is applied to each roller. This accommodates temporary jamming of any basket which inevitably occurs from time to time In the washing unit 16, the bowl, plates and other wares are subject to washing by high temperature, soap and water. In known manner, as followed by a rinsing step. The water is then drained from the baskets and the baskets pass into the drying unit 18, where the individual items are dried by hot air.

Conventionally, the individual utensils would be washed and dried separately. After drying, they would then be removed, while still warm, and stacked for storage, Moreover, in conventional kitchens, there is no attempt to keep utensils together in sets. In other words, all of the plates would be stored together and similarly the bowls, cutlery etc. would all be stored separately, with like items being stored together.

Here, the baskets 100 keep the equipment together in sets. Additionally, after exit from the dying unit 18, the second conveyor 20, in which can be an extension of the first conveyor 14, carries the baskets 100 into a cooling unit 22. Here, chilled air cools the dried wares down. The reason for this is to enable the bowls, plates to be immediately recharged with fresh food. If they were warm, this would run the risk of promoting growth of bacteria and the like, which could cause food poisoning.

Figure 3:
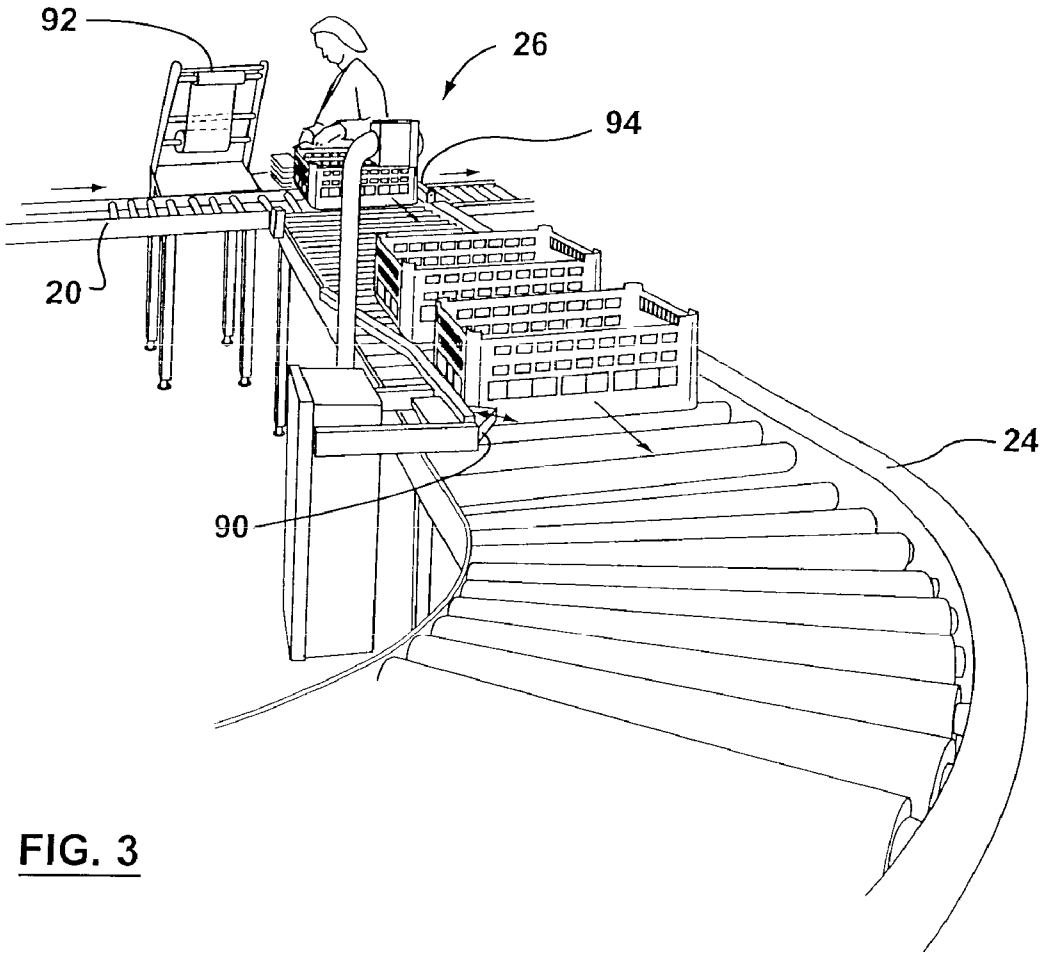
FIG. 3 is a perspective view, in the direction of the arrow B of FIG. 1, showing a discharge station of the assembly of FIG. 1.
Figure 4:
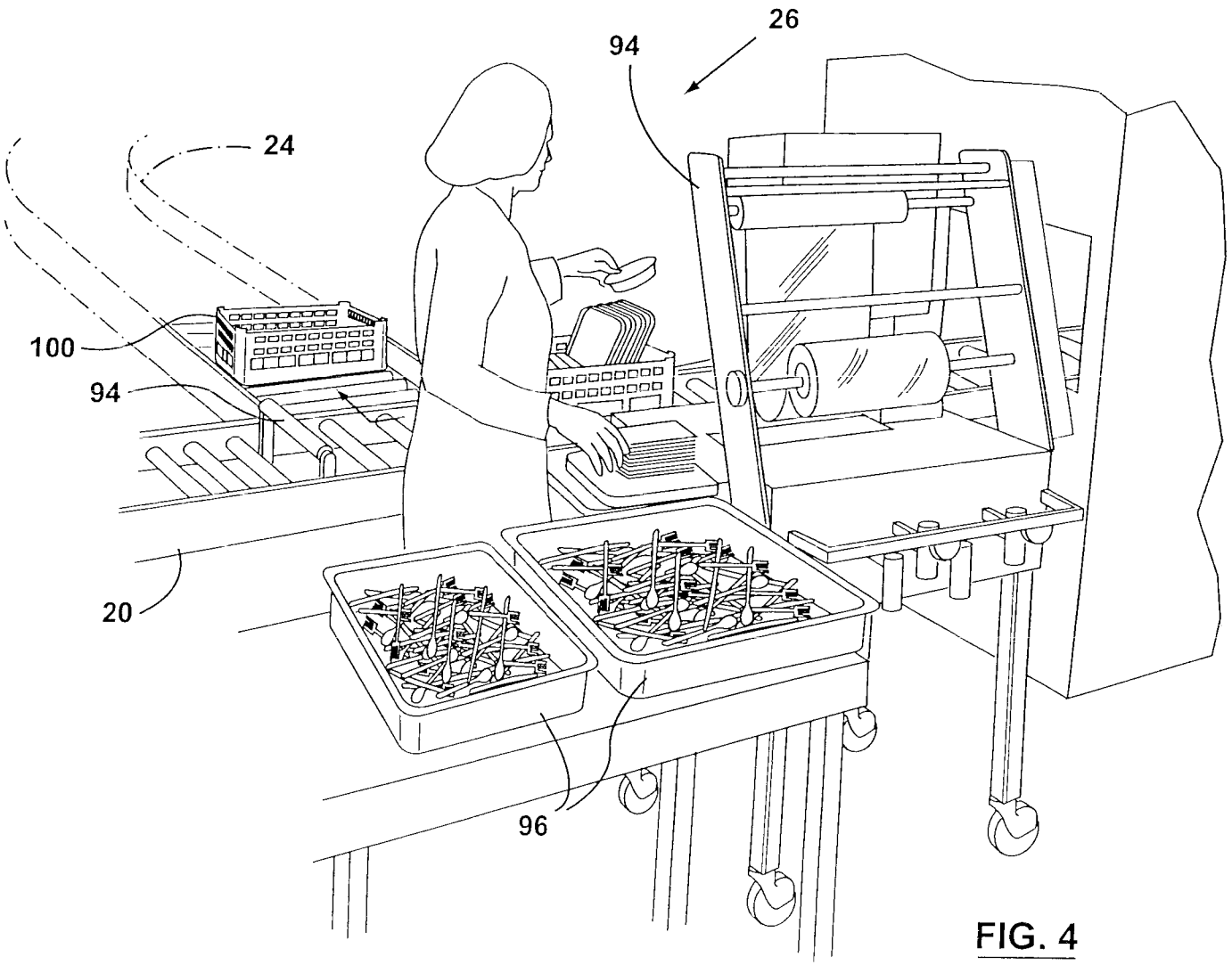
FIG. 4 is a perspective view, in the direction of the arrow C of FIG. 1, of the discharge station.

After leaving the cooling unit 22, the baskets 100 arrive at the discharge station 26. The discharge station 26 is shown in more detail in the perspective drawings of FIGS. 3 and 4. As shown in FIGS. 3 and 4, a worker at the discharge station 26 is able to control a movement of the baskets 100 using a basket-directing roller 94, which is operable with a pedal (not shown). In a raised position, this basket-directing roller 94 blocks further movement of a basket 100 in the direction of the second conveyor 20. Consequently, the basket is then picked up by the third conveyor 24 and transported through the discharge station, extending along the first, straight portion of the conveyor 24. As detailed below, if the roller 94 is lowered, baskets continue through to a galley line, before the conveyor 24 has time to move them transversely.

While cutlery in the baskets 100 is generally kept together in sets, at a cutlery bagging station adjacent a bagging mechanism 92, the cutlery is removed from the baskets and stored in trays 96. Generally, it is not considered essential to maintain a strict correspondence between sets of cutlery removed from the baskets 100, and clean cutlery that is rearranged into sets and bagged for further use. Thus, at the cutlery bagging station, the bagging mechanism 92 is a conventional mechanism that provides for bagging cutlery in a sealed plastic bag. This provides two sheets of plastic, which are supplied and brought together to define a generally V-shaped receiving area for the cutlery. Typically, a set of cutlery, condiments such as salt and pepper and a disposable napkin are put together in the V-shaped area. Where required, one or more disposable cutlery items can be provided. The machine is then operated to seal the plastic around the cutlery and other items, to form a sealed pouch, which is then cut from the plastic film and released. The sequence is then repeated. It will be understood that, depending on the particular application, different items can be inserted into the cutlery bags or pouches. The sealed bags of cutlery are then placed back into the baskets, for unloading with the wares, as described below. The operator at the bagging mechanism 72 also controls the basket-directing roller 94.

After directing the baskets 100 onto the return conveyor 24, another worker is able to stop movement of the baskets 100 along conveyor 24 by means of a basket stop 90. The basket stop 90 is spring loaded, so as normally to block the path of travel of the baskets 100 along the conveyor 24, enabling the worker to stop the baskets to enable removal of all of their contents. A foot or hand operated mechanism is provided, to enable the stop 90 to be withdrawn, to release the baskets once they have been emptied.

Figure 5:
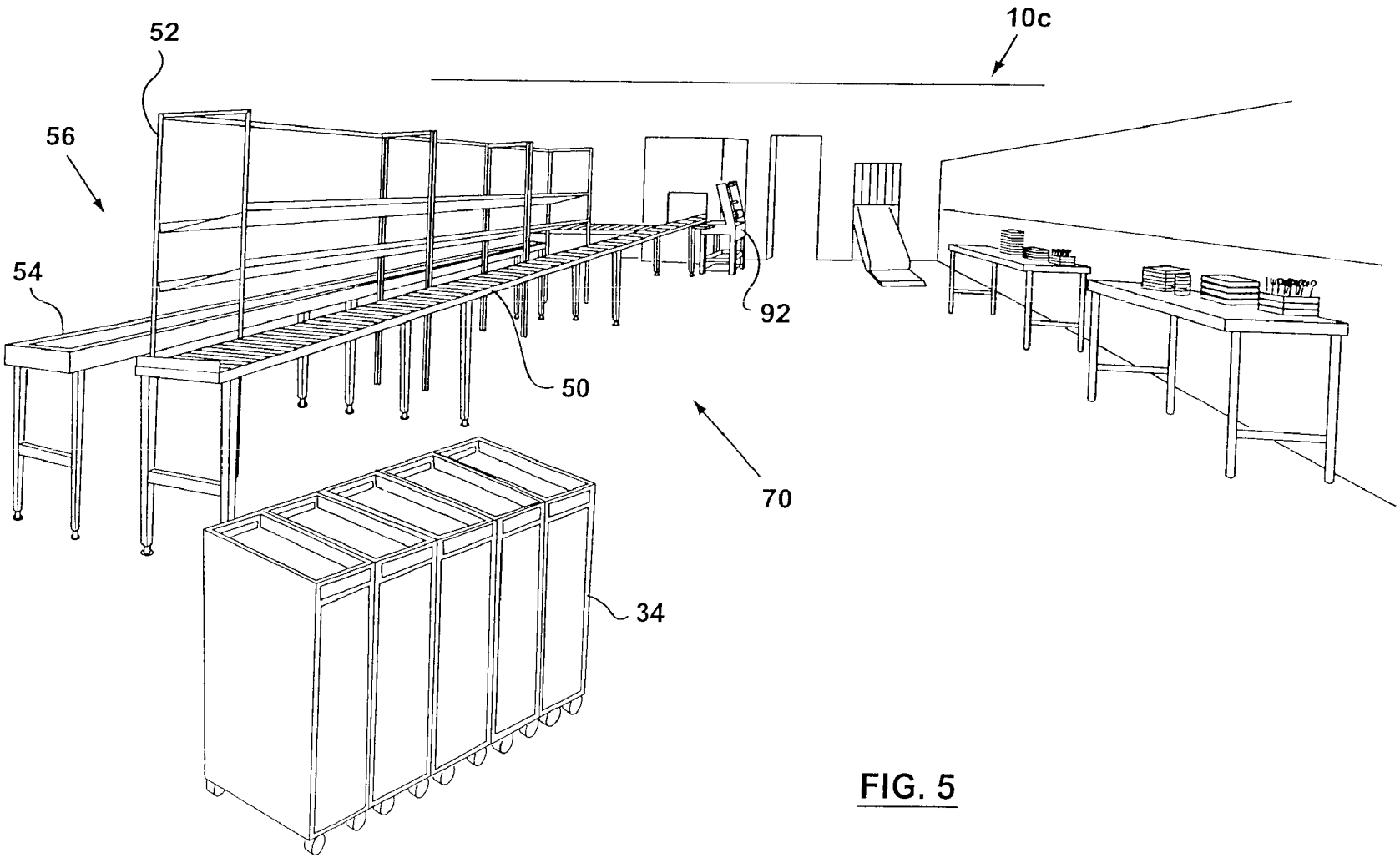
FIG. 5 is a perspective view, in the direction of the arrow D of FIG. 1, showing a loading room of the assembly of FIG. 1.
Figure 6:
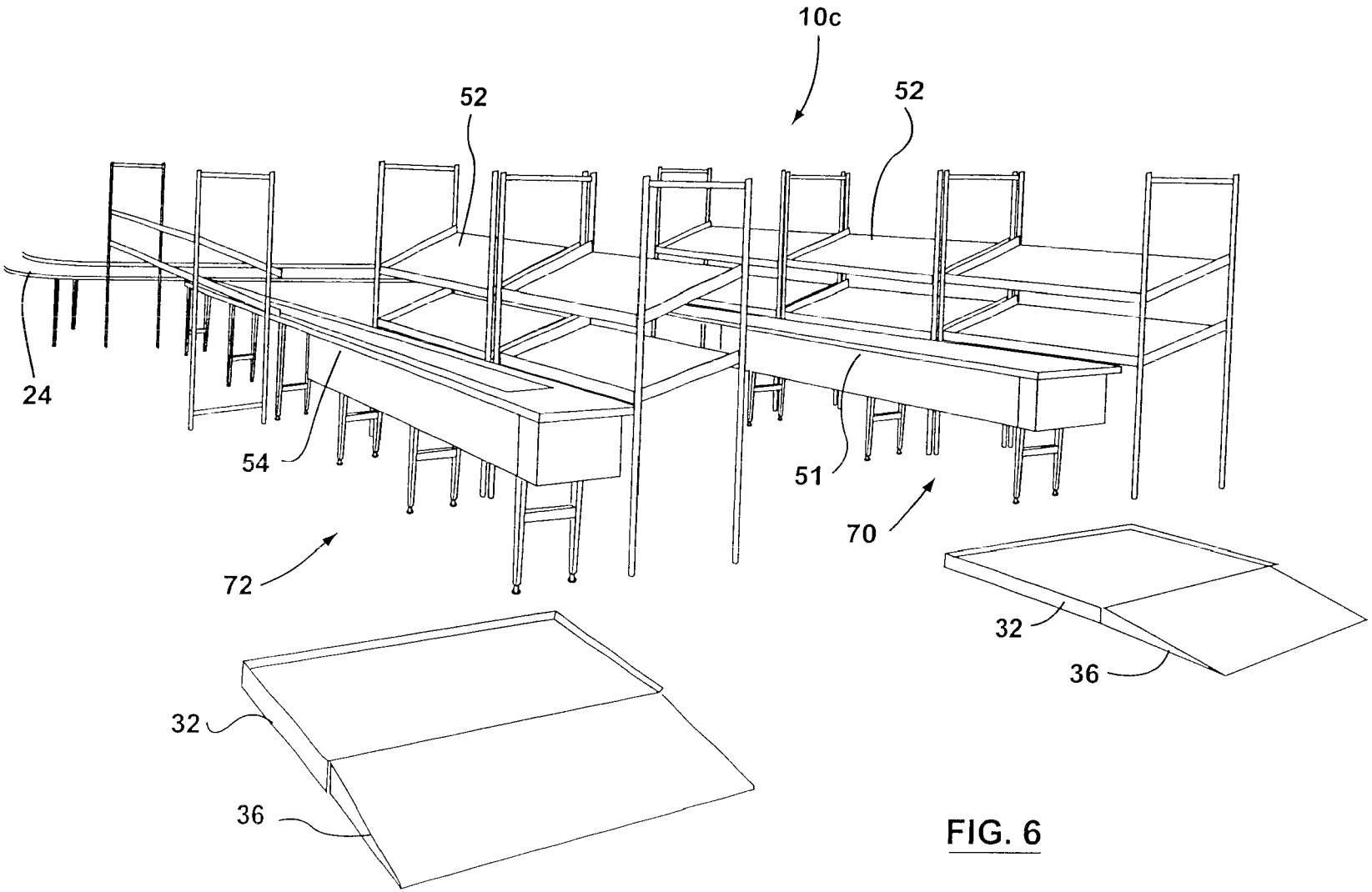
FIG. 6 is a perspective view, in the direction of arrow E of FIG. 1, showing the loading room of the assembly.

As shown in FIG. 1, and, in more detail, in FIGS. 5 and 6, after the wares are unloaded from the baskets 100 at the discharge station 26, the wares are sent further into the loading room 10*c* on loading conveyors 50, 54.

As shown in FIGS. 1 and 6, the loading room 10*c* includes two separate lines: a galley line 70 and a regular line 72. These different lines can be used to load different types of food onto different wares. For example, in the context of preparing meals for aircraft, line 70 could be used for preparing galley carts, containing, say, coffee, juice and water, tongs, coffee and water jugs, napkins and trays of cups and glasses to use in business class for distribution to passengers, as well as business class meals, while line 72 is used to prepare meals for regular economy passengers. By separating these tasks into different lines, each line is able to focus on its specific task to a greater extent.

As shown at 55, the loading conveyor 50 extends on one side of a series of shelves 52. On the other side of the shelves 52, there is a conveyor 51. As shown, a pair of operators 65 can work at the conveyor 51, preparing business class meals. Commonly, business class meals are considerable more complex and are prepared in much smaller quantities, so that the techniques for preparing large numbers of economy class meals are not so applicable. The business class wares are removed from the conveyor 50 and stored on the shelves 52.

The shelves 62 which can include refrigerated space, also serve to hold foodstuffs to be assembled into the business class wares. Additionally, as some of the business class meals can be complex, sometimes wares will be removed for filling with such meals at another location, and then returned already filled.

The galley wares are taken off the conveyor 50 on the side remote from the conveyor 51, and can either immediately be assembled into galley carts, or placed on the shelves 52 until required.

The operator controlling the directing roller 94 looks out for galley wares and business class wares (e.g. baskets containing just glasses for business class, coffee pots, etc.), and directs these along the conveyor 50

Where economy class wares are being processed together with business and galley wares, it is preferred to have three operators at the sorter station 12. Two operator are located at one of the locations 30, 31 handling the economy class wares. The third operator is located at the other of the locations 30, 31, handling the galley and business class wares. This arrangement enables simultaneous processing of economy class wares, business class wares, and galley wares (or just two of these categories).

As indicated in FIG. 1, various additional carts, trolleys, tables and the like can be provided adjacent the loading conveyor 50 of the line 72, for preparing galley carts.

For the line 72, the basket directing roller 94 is used to direct baskets along the conveyor 24 towards the line 72. An operator 56*a* then uses the basket stop 90 to stop each basket. Each basket is then unloaded of its wares, including the already packaged cutlery. This operator 56*a* assembles the basic tray and can place a few additional or missing items on the tray, as required, from shelves facing that operator.

The assembled tray then passes along a conveyor 54 of the line 72, passing first by an operator 66*b* and then by two operators 56*c*. Each of these operators 56*b*, 56*c* adds additional foodstuffs to the wares already assembled on the tray, until at the end of the line 72, there is a complete tray. This assembly of trayed meals is commonly referred to in the airline industry as "on line portioning and plating of food". The completed tray is taken by the last operator and placed into a cart. Again, as shown in FIG. 6, lift 32 can be provided, for raising a cart up to a convenient height, for loading or the cart.

Loaded carts can then be wheeled from the loading or clean room 10*c* into a refrigerated storage room.

To keep the configuration compact, the third conveyor includes a semicircular curved section 24*d* and a ninety degree curved section 24*e*, each including tapered rollers in known manner. This keeps parallel sections of conveyors 14, 24 close together, to minimize space requirements.

The empty baskets 100, after release from the basket stop 90, are returned by the third or return conveyor 24 to the sorter station 12, or reloading. Additionally, this enables any items that have not been properly cleaned to be returned for a second pass through the washing unit 16 (FIG. 7 shows this practice). Thus, at the discharge station 26, an operator will usually keep a supply of all of the different bowls, plates, utensils, in case any are missing or dirty for any individual sets of equipment. These additional, spare items are then used to make up complete sets on the trays. As noted, any soiled or improperly cleaned items are returned in the baskets along the conveyor 24.

Figure 8:
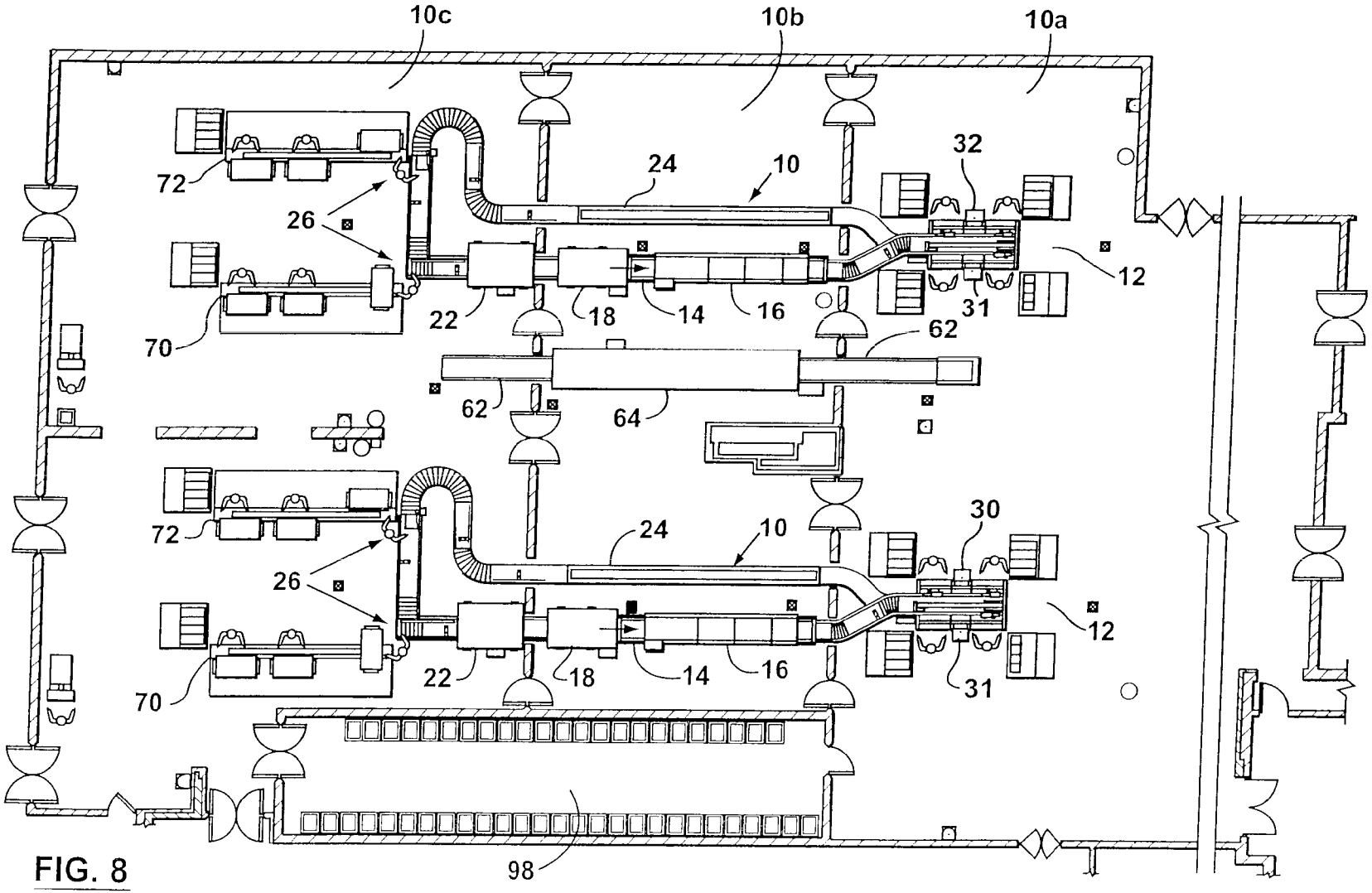
FIG. 8 is a plan view of an assembly in accordance with a second embodiment of the present invention.

Referring to FIG. 8, there is illustrated in a plan view an assembly in accordance with a second embodiment of the invention. The assembly is quite similar to the assembly of FIG. 1, but includes two lines operating in parallel. If other words, there are two sorter stations 12, two conveyors carrying the wares through one of two cleaning units 16 and drying units 18. A single cart conveyor 62 is included in the assembly. Also included is a storage fridge 98 for storing the loaded carts received from the loading lines 70 and 72.

Accordingly, in FIG. 8, like components are given the same reference numeral as in FIG. 1, and for brevity and simplicity the descriptions of these components is not repeated.

Here, the two locations 30, 31, for each sorter station 12 are essentially identical and symmetrical about the input end of each line. In contrast, in the earlier embodiment, shown in FIG. 1, the two locations 30, 31 could be different. In FIG. 1, this was intended to cover the case where one location could primarily be used for wares for galley use and the like, while the other location would be used for trayed wares.

In FIG. 8, the two lines are both set up to handle solely trayed wares for economy class passengers. As shown, for this purpose, four operators can work at each input station 12, two on each side. This enables greater throughput of wares, without having to increase the speed of the conveyors, and is applicable when there are no galley and business class wares (or their quantities are insignificant).

Correspondingly, at the output side, in the clean room 10*c*, the two lines 70, 72 correspond and are both intended for assembly of trayed meals. Each line 70, 72 would be provided with a conveyor system, and necessary shelving to enable complete trays to be prepared.

Figure 8B:
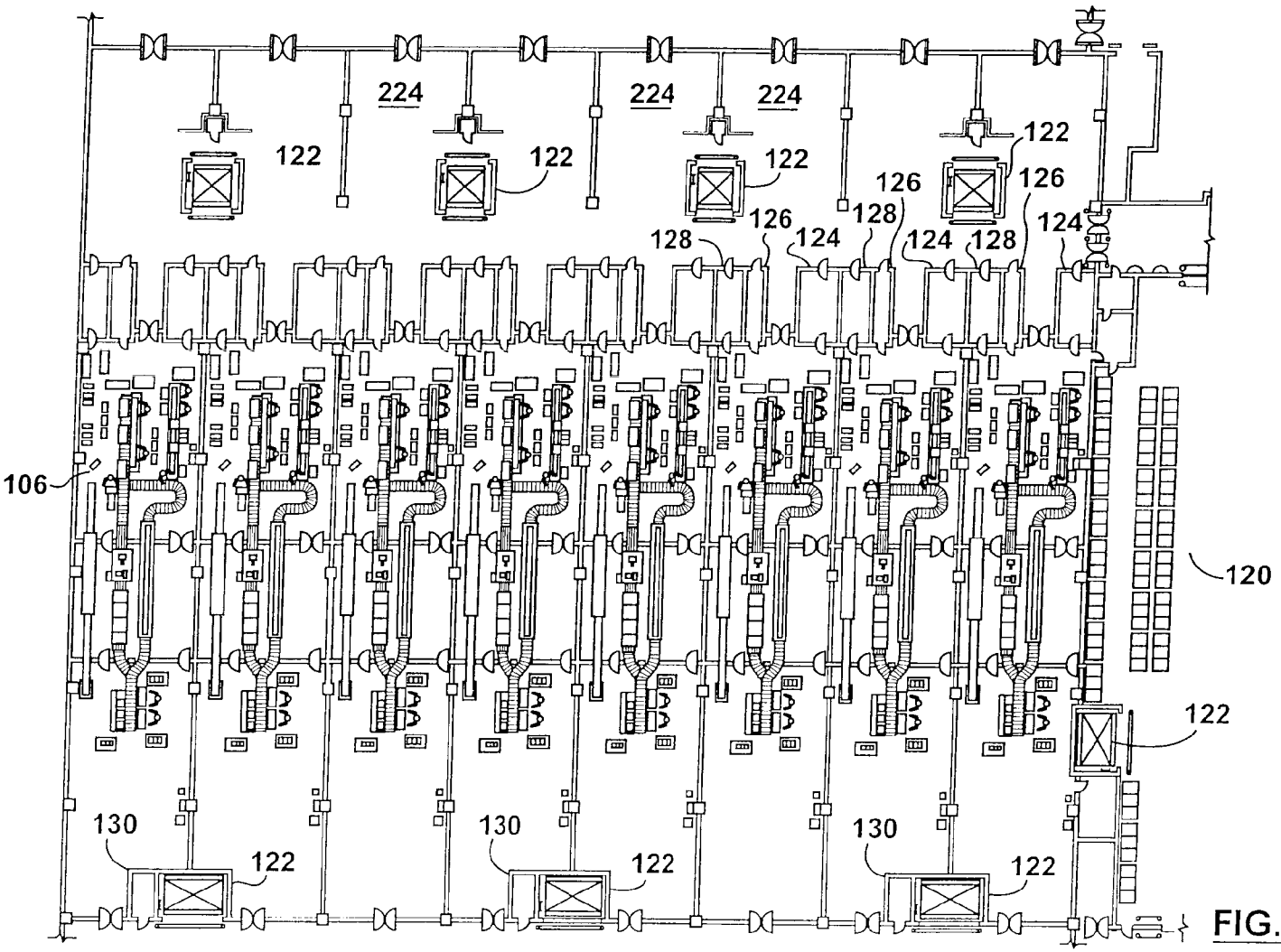
FIG. 8*b* is a plan view of an assembly in accordance with a third embodiment of the present invention.

Referring to FIG. 8*b*, there is illustrated a further assembly in accordance with an embodiment of the invention. This assembly is similar to the assemblies of FIGS. 1 and 8; however, the assembly of FIG. 8*b* includes eight lines operating in parallel. The dividing walls between the lines need not be a complete wall and could, at least in the inbound soil rooms 10*a* and the clean assembly rooms 10*c* simply comprise partitions of a certain height. Additionally, the assembly of FIG. 8*b* includes elevators 122 at both of its ends. Each clean assembly room 10*c* of the assembly of FIG. 8*b* has adjoining it, a cooler 124, a freezer 126 and a storage room 128. The assembly also includes a cart storage room 120. This cart storage room 120 has its own elevator 122. Three detergent storage rooms 130 are also provided. Three elevators 122 are provided at the upstream or input end of the assembly 10, and four elevators 122 are provided at the downstream end of the assembly 10. Also, refrigerated storage rooms 224 are provided, for holding complete sets of carts, including economy class meals, business meals and galley wares, together with commissary carts, prepared as detailed below.

The assembly of FIG. 8*b* is part of a larger assembly. The other part of this assembly is shown in FIG. 8*d*. On commercial passenger aircraft, it is usual that some carts 34 will be loaded with commissary goods, such as alcohol, perfume, soft drinks and other boutique items, newspapers and magazines, etc. The specific kinds of commissary goods will depend on the airline, and these commissary goods are owned by the different airlines. Referring to FIG. 8*d*, an upper floor accessible via elevators 122 of the assembly of FIG. 8*b* is shown. Carts are carried up by the three elevators 122 at the input end to the upper floor containing the commissary zone 210. Thus, when carts or trolleys are returned from an airline, they are usually received together at an input station of the assembly 8*b*, outside of the receiving rooms 10*a* for each of the lines or assemblies shown in FIG. 8*b*. The carts containing consumed and dirty trays, galley items and the like are then passed through the doors shown into the individual lines. Simultaneously, the carts containing commissary items are taken by the three elevators 122 to the upper floor shown in FIG. 8*d*.

A cart cleaning station is indicated at 220 in FIG. 8*d*. Generally, cleaning of commissary carts is mush less burdensome, and in many cases minimal cleaning is required. After any required cleaning, the commissary carts can be restocked. Generally, partially consumed commissary items will have to be disposed of. It is accepted practice that for some alcoholic beverages, partially consumed bottles can be reused or combined. For example, for spirits such as whisky and the like, it is acceptable to take part used bottles and combine them to give a full bottle for use.

Then, these carts 34 can be stocked with commissary goods taken from shelves in the commissary zone 210. The commissary zone 210 is divided into separate caged regions 216. These regions or areas are caged, since many of the items, e.g. alcohol and tobacco, are of high value and equally subject to stand control, by customs authorities and the like. Each of the separate caged regions belongs to a different airline and contains goods belonging to that airline. The size or the different caged regions 216 will vary depending upon the requirements of each airline, and smaller airlines may even have shared caged regions or storage areas. Commissary goods for that airline can then be loaded onto carts 34 and taken down to the assembly of FIG. 8*b* to be assembled with the other carts 34, containing food and galley items, for distribution to the aircraft. Commonly, loading of commissary carts occurs in each caged region 216, and hence such loading is more of a point operation, than a continuous linear operation along a conveyor.

The filled commissary carts are taken down in the four elevators at the downstream, end of the assembly. As shown, a holding room 222 can be provided adjacent at least some of the elevators, and in many cases this room will be kept chilled. The prime reason for this is that it is preferred for many alcoholic beverages to be served chilled, and there is little disadvantage if other commissary items, e.g. newspapers, are incidentally chilled in the process.

Figure 8C:
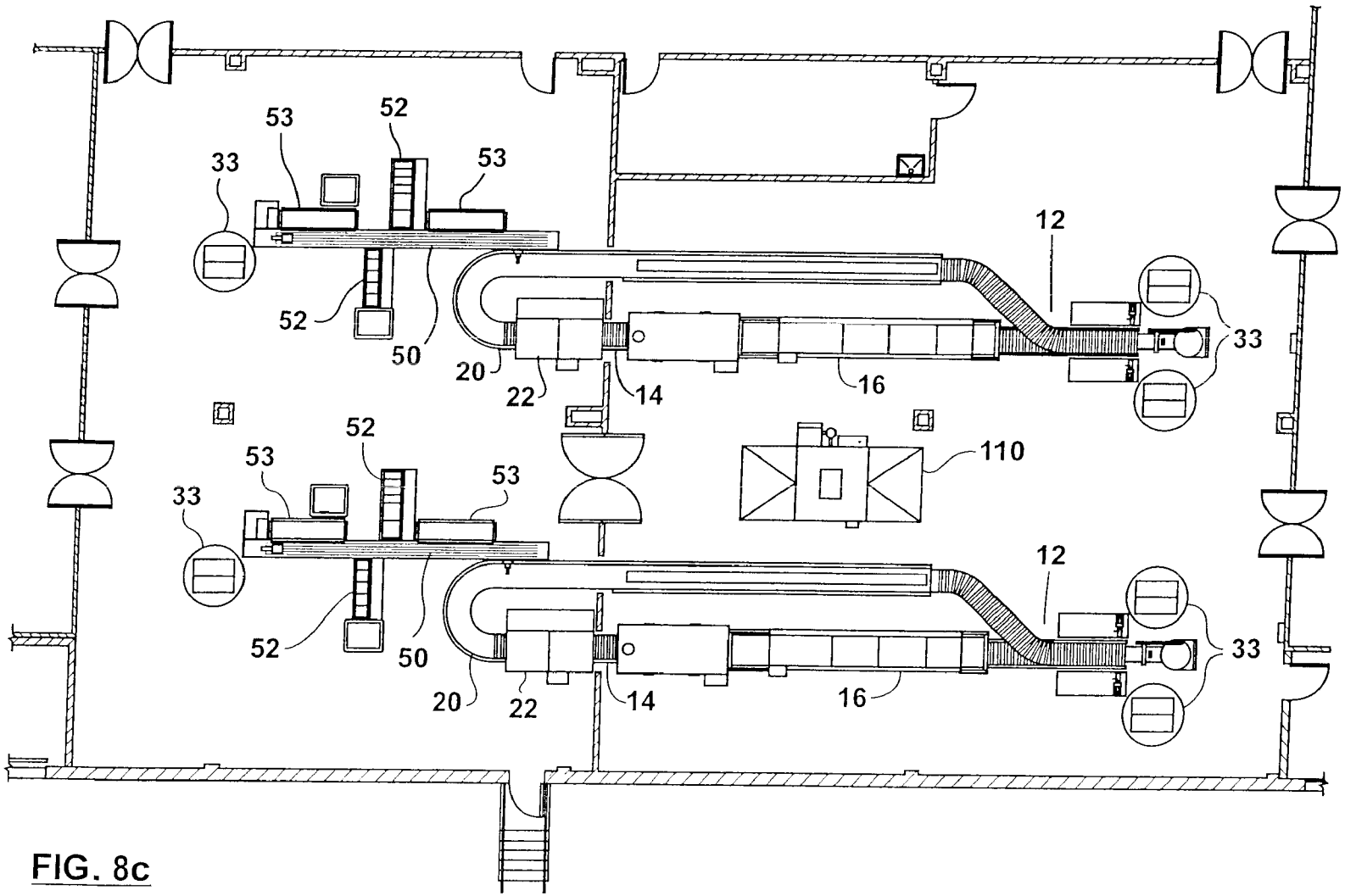
FIG. 8*c* is a plan view of an assembly in accordance with a fourth embodiment of the present invention.
Figure 8D:
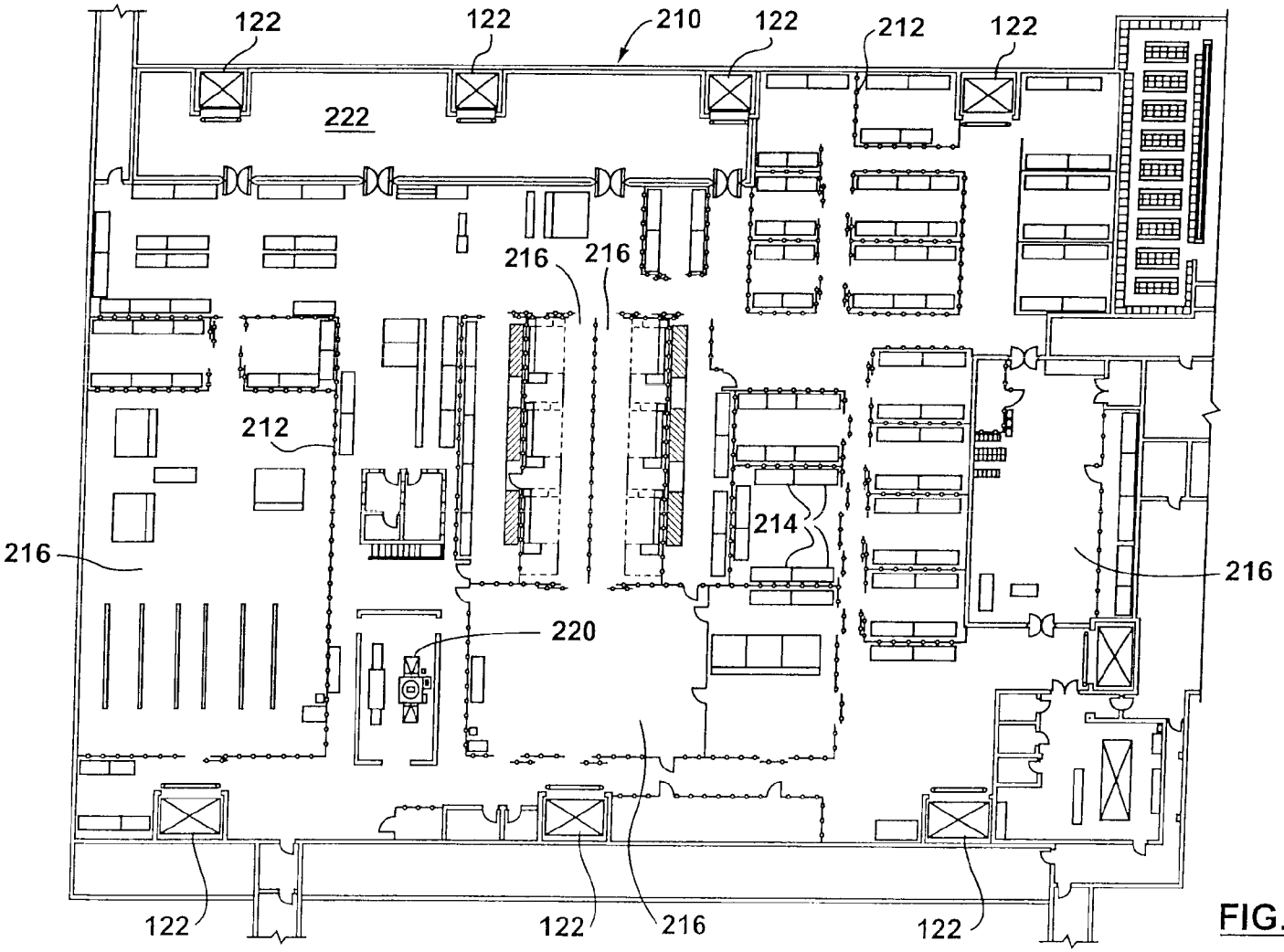
FIG. 8*d* is a plan view of a commissary layout in accordance with the third embodiment of the invention.

Referring to FIG. 8*c*, there is illustrated in a plan view an assembly of an embodiment of the invention suitable for implementation in a hospital, healthcare and other institutional settings, in which the wares are not subject to the same space limitations as on aircraft. A significant difference between such an institutional implementation and an airline implementation is that in hospitals and the like, the patients or other customers for the meals are given significant selective options from a menu. Consequently, the assembly task is much more complex, and allowance has to be made for this in the clean, assembly room. Apart from this difference, the assembly of FIG. 8*c* is quite similar to the assembly of FIG. 8. Specifically, the assembly of FIG. 8*c* includes two lines operating in parallel. In other words, there are two input stations 12 and two conveyors 14 for carrying the wares through one of two cleaning units 16 and drying units 18. A single cart cleaner 110 is included in the assembly between the lines.

There are a few differences between the assemblies of FIG. 8*c* and FIG. 8. Specifically, reflecting the differences between the carts used in hospitals and the carts used on aircraft, the cart washer 110 does not include a conveying unit. Instead, the carts 34 are simply pushed into the washing unit 110 for washing.

Due to the differences between the carts 34 for use on aircraft and the carts for use in hospitals, the lifts 33 shown in FIG. 8*c* differ slightly from the scissor lifts 32. Specifically, aircraft carts 34 are designed so that trays can be removed from either side of the cart 34, i.e. they have a "pass through" design. However, many hospital carts are not designed in this way, as hospital carts are not used in the same confined spaces that aircraft carts 34 are used. Thus, many hospital carts usually have a central divider, so that some trays have to be removed from one side and other trays removed from the other side. Accordingly, in order to facilitate of unloading of hospital carts, the hospital cart lifts 33 are rotatable such that after trays from one side of the hospital cart have been removed, the lift can be rotated to rotate the hospital cart to make the other trays accessible. It is to be noted that other hospital carts are of a "pass through" design, permitting loading from one end. It will also be understood that for carts with a central divider, this rotation facility should be provided for both loading and unloading.

Similar to the assembly of FIG. 8, the assembly of FIG. 8*c* includes loading conveyors 50 which receive wares from second conveyors 20. Adjacent to loading conveyor 50 are loading tables 63, which provide surfaces on which workers can reload the wares with food. Also adjoining loading conveyor 50 are shelving units 52 on which foodstuffs are temporarily placed. Here, and in other embodiments, the units 52 could be more than simple shelving, and could include some refrigeration capacity.

Figure 9A:
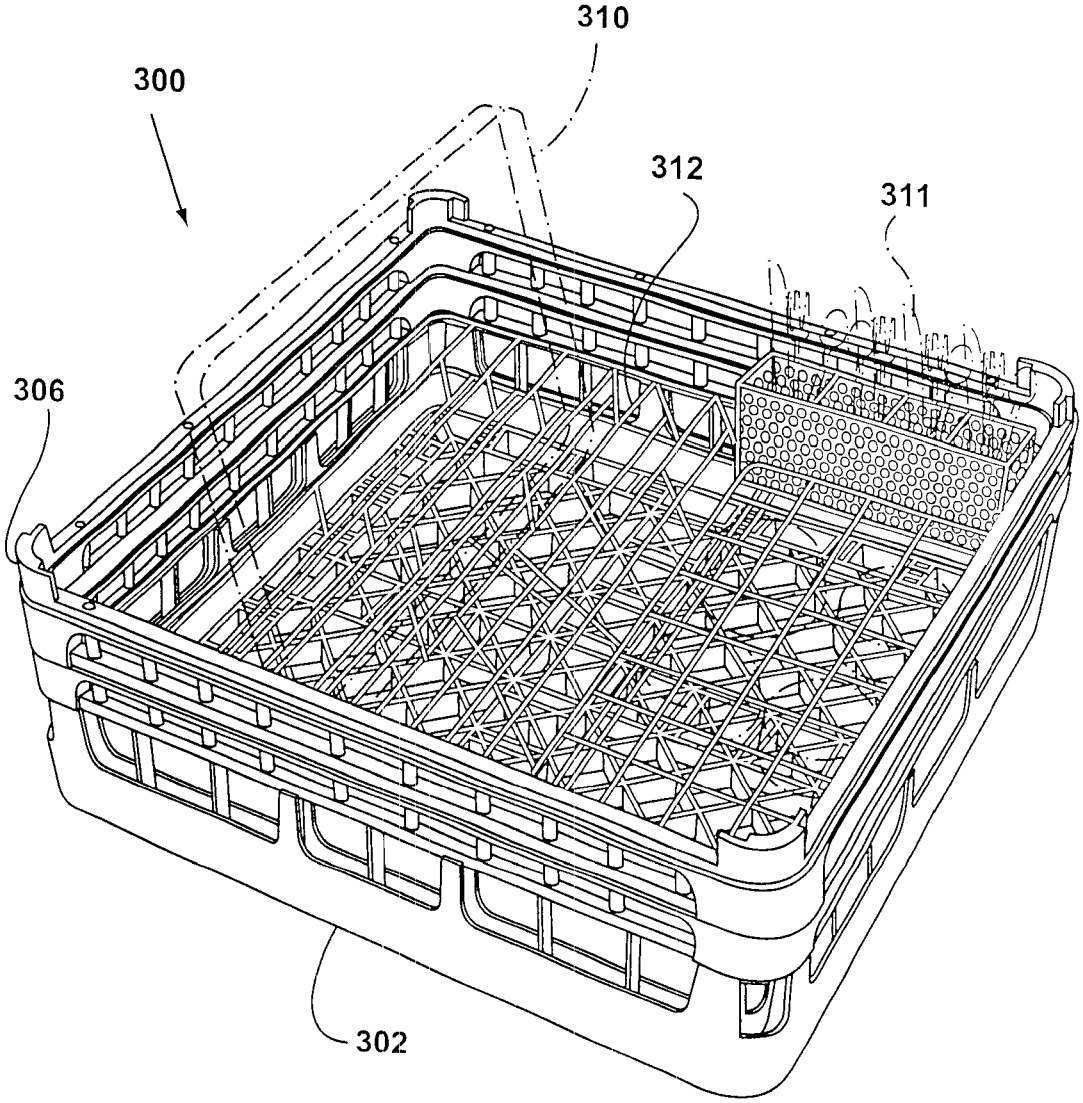
FIG. 9*a* is a perspective view of a basket in accordance with the preferred embodiment of the invention.

Referring to FIG. 9*a*, there is illustrated in a perspective view, a basket 300 in accordance with a preferred embodiment of the invention. The basket 300 comprises a base portion 302 and an extension portion 306. The basic basket design can be conventional, and such baskets are commonly molded in a plastic material. Further, as shown best in the exploded perspective view of FIG. 9*d*, the basket 310 includes a frame 304 that is insertable into the base portion 302.

Again referring to FIG. 9*d*, the frame 304 includes a cutlery holder 308, as well as parallel members 312. Parallel members 312 are aligned to hold items such as tray 310 shown in stippled lines in FIGS. 9*a* and 9*b*. Frame 304 also includes flange positions 322, which flange portions 322 each include a screw-receiving aperture 324. The parallel members are essentially arranged in upper and lower parallel planes, with short connecting numbers. Towards the center of the frame 304, some of the parallel members 312 are arranged in sets of three, effectively defining surfaces that separate slots from one another.

Extension 306 and base portion 302 both include threaded bores 316. When extension 306 is placed over base portion 302 such that their corners align, then the threaded bores 316 also align. Screws 314 may then be inserted down through threaded bores 316 of extension 306 into threaded bores 316 of base portion 302. In order to secure the frame 304 in place within the basket 300, flange portions 322 of frame 304 project over the sides of base portion 302, such that flange apertures 324 align with threaded bores 316. Then, when extension 306 is placed over the base portion 302, and the threaded bores 316 are aligned, screws 314 may be inserted through the threaded bores 316 of extension 306, and then through the screw-receiving apertures 324 of flanges portion 322 before projecting into threaded bores 316 of base portion 302, thereby securing frame 304 in place.

Figure 9B:
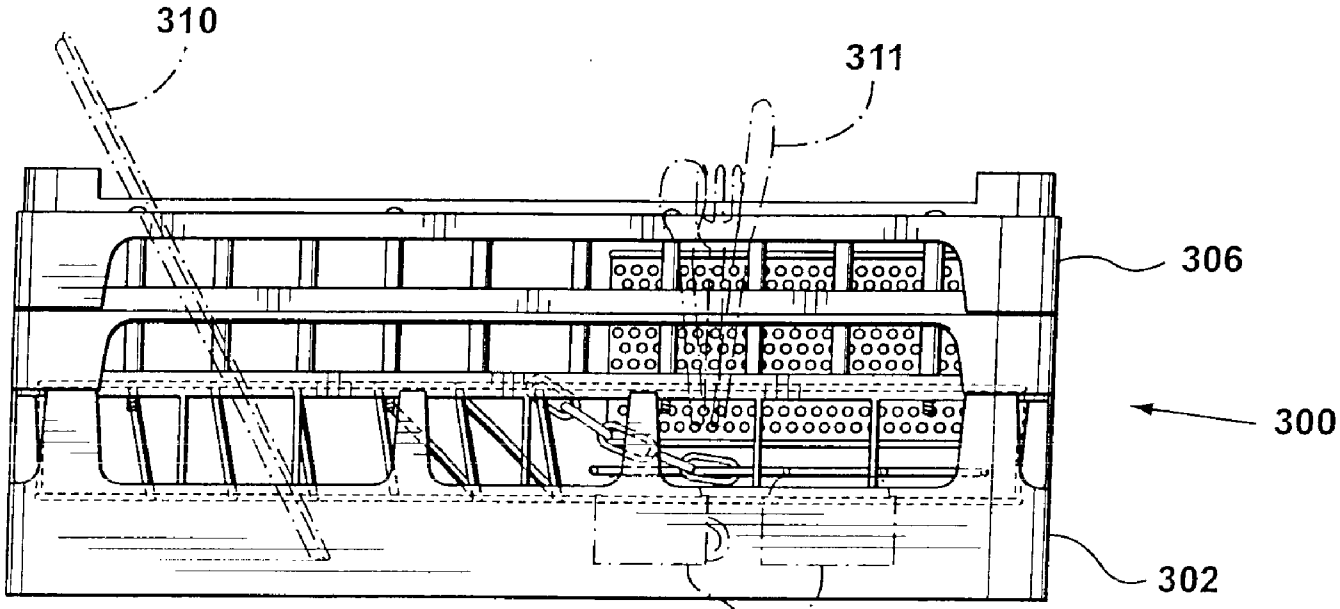
FIG. 9*b* is a side view of the basket of FIG. 9*a;*
Figure 9C:
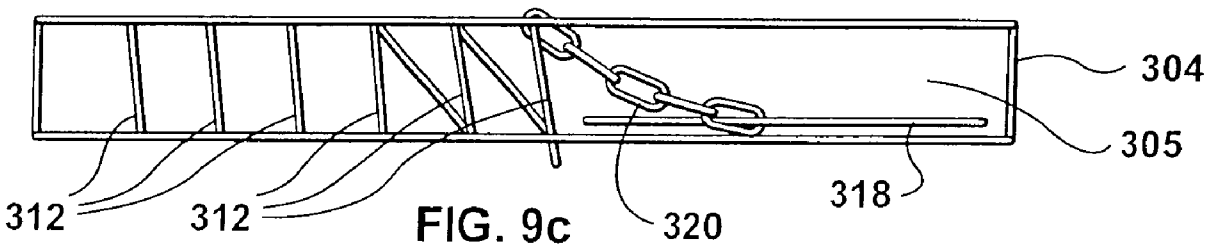
FIG. 9*c* is a side view of a frame in the basket of FIG. 9*b*.
Figure 9D:
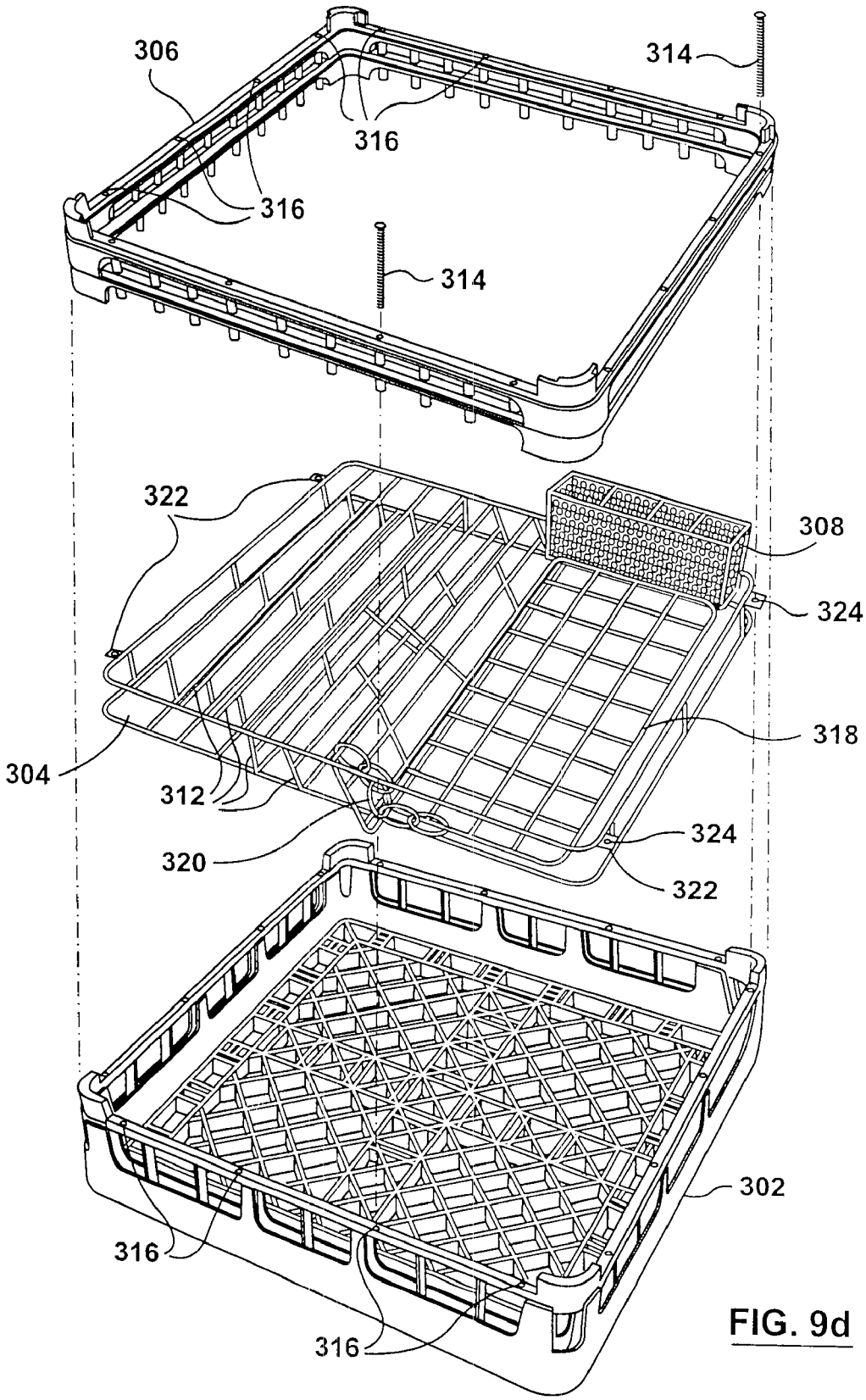
FIG. 9*d*, is an exploded perspective view, which illustrates the basket of FIG. 9*a.*

In addition to having parallel members 312 for locating members such as trays 310, and a cutlery holder 300 for securing cutlery 311, frame 304 also includes an open portion 305 for holding items such as cups and mugs 326. These items may, particularly in aircraft contexts, be quite light. When subjected to the high pressure cleaning process of washing unit 16, they are apt to be thrown about. Accordingly, to limit the movement of these lighter items, frame 304 includes a frame cover 318. This frame cover is placed on top of the cups and mugs 326 in the open portion 305 of the frame 304 to prevent these cups and mugs 326 from being moved out of the basket 300 by the high pressure cleaning of the washing unit 16. As best shown in FIGS. 9*b* and 9*c*, to prevent separation of the cover 318 from the frame 304, the cover 318 is connected to the frame 304 by a chain 320.

It will be understood that the design of the frame 304 will depend upon the dimensions of wares to be inserted into it. It may be necessary to design different names 304 for wares from different airlines, and in general hospital or institutional applications will require frames 304 with different dimensions and/or layout.

In order to facilitate both washing and drying, the base portion 302, extension 306, and a frame 304 are constructed to have a mesh or grate-like appearance with many openings, to enable both water and air to move freely through all portions of the basket 300. This is also true of the frame cover 318, which is a heavy metal grate, heavy enough to secure the cups and mugs 326, while having large openings to permit water and air through to wash and dry the cups and mugs 326 respectively.

It will be appreciated that while a preferred embodiment of the present invention has been described, many variations are possible within the scope and spirit of the invention. For example, while the invention has been described as including a basket for keeping sets of wares together and for passing the sets of wares through the washing and drying units, etc., this is not essential. A key concept behind the present invention is to retain sets of wares together and to refill the wares immediately for re-use, rather than store the wares, not in sets for reuse at a later time.

Thus, it is conceivable that the conveyor system could be configured to take the wares through the washing and drying units and the cooling unit without requiring a basket. To facilitate keeping the wares in sets, the various conveyors could, effectively, be divided into separate tracks, each track being intended for one particular type of ware, for example, one track for plates, another for cups, another for bowls, etc. It may well be that such technique would not keep the wares together in sets as exactly as the present invention, but this can be accommodated by providing greater flexibility at the discharge station 26 and by keeping a larger stock of spare wares there, to replace any missing items or items that need to be returned for further washing. Such an arrangement may well enable the greater throughput of wares.

We claim:

1. An assembly for washing soiled wares and providing the wares for refilling and reuse, the assembly comprising:

a sorter station for receiving soiled wares and for sorting the wares into baskets;

a discharge station for removing clean wares from the baskets and reassembling wares into sets of wares;

a substantially continuous conveyor means extending between the sorter station and the discharge station and back from the discharge station to the sorter station, for conveying baskets with wares;

a washing and drying means provided on the conveyor means;

a cooling means provided on the conveyor means; and a refilling station, at the discharge station, for refilling the wares, the refilling station having a plurality of distinct refilling lines for refilling the wares, the wares being directable to any one of the distinct refilling lines;

wherein the sorter station, conveyor means, washing and drying means, and cooling means are arranged such that baskets containing sets of wares are sequentially subject to washing, drying and cooling between the sorter and discharge stations.

2. The assembly as defined in claim 1 wherein each of the plurality of distinct refilling lines is adapted for refilling the wares with different contents.

3. The assembly as defined in claim 2 wherein the wares are loadable on carts, the assembly further comprising a cart washing line for washing carts.

4. The assembly as defined in claim 2 wherein the wares are for use on aircraft and the plurality of distinct refilling lines includes a galley refilling line for galley wares for distribution to passengers on an aircraft.

5. The assembly as defined in claim 4 wherein the galley line is also adapted to handle business class wares and to refill the business class wares with business class meals, and wherein the plurality of distinct refilling lines includes an economy refilling line for refilling economy class wares with economy class meals, whereby galley wares, business class wares and economy class wares are processed simultaneously.

6. The assembly as defined in claim 1 further comprising a commissary zone, the commissary zone comprising a commissary storage station for storing the plurality of commissary goods, whereby commissary carts can be processed and refilled substantially simultaneously with the wares.

7. The assembly as defined in claim 1 wherein each refilling line in the plurality of distinct refilling lines includes two refiller locations on each side thereof.

8. The assembly as defined in claim 1 wherein the sorter station comprises a soaker sink for soaking wares prior to washing to facilitate removal of debris.

9. The assembly as defined in claim 1 wherein the conveying means is elevated to facilitate removal of the wares therefrom.

10. The assembly as defined in claim 1 wherein the assembly is divided between a plurality of rooms spanned by the conveyor means, the plurality of rooms including an inbound, soil room containing the sorter station;

a machine room containing the washing and drying means; and, a clean, assembly room containing the discharge station and the refilling station.

11. The assembly as defined in claim 10, wherein the assembly includes means for refrigerating the inbound, soil room and the clean, assembly room.

12. An assembly, for washing soiled wares and providing the wares for refilling in use, the assembly comprising:

a first line for receiving soiled wares, washing soiled wares, drying washed wares, refilling the wares and providing refilled wares on trays and stacking the trays in first carts;

a second line for washing first carts for the wares; and a commissary zone for at least restocking second carts with commissary goods.

13. An assembly as claimed in claim 12, wherein the first line includes:

a sorter station at which trays with soiled wares are removed from the first carts, sorted into baskets and the baskets are placed on the first line for washing;

a discharge station for removing clean wares from the baskets and reassembling the wares into sets of wares;

a substantially continuous conveyor means extending between the sorter station and the discharge station and back from the discharge station to the sorter station for conveying baskets with wares;

a washing and drying means provided on the conveyor means between the sorter station and the discharge station;

a cooling means provided on the conveyor means between the washing and drying means of the discharge station; and at least one refilling station at the discharge station for refilling the wares, assembling the wares on trays and inserting the trays back into the first cart;

wherein the sorter station, conveyor means, washing and drying means, and cooling means are arranged such that baskets containing sets of wares are sequentially subject to washing, drying and cooling between the sorter and discharge stations.

14. An assembly as claimed in claim 13, wherein the first and second lines are provided substantially side by side at the same level.

15. An assembly as claimed in claim 14, wherein the commissary zone is provided at a different level from the first and second lines.

16. An assembly as claimed in claim 15, wherein the commissary zone includes a separate station for cleaning the second carts.

17. An assembly as claimed in claim 16, wherein the commissary zone includes secured, enclosed areas for storing commissary goods.

18. An assembly as claimed in claim 17, which includes at least one cooled storage area, for storing at least one of the first and second carts after refilling thereof.

19. An assembly for washing soiled wares and providing the wares for refilling and reuse, the assembly comprising:

a sorter station for receiving soiled wares and for sorting the wares into baskets;

a discharge station for removing clean wares from the baskets and reassembling wares into sets;

a substantially continuous conveyor means extending between the sorter station and the discharge station and back from the discharge station to the sorter station, for conveying baskets with wares;

a washing and drying means provided on the conveyor means between the sorter station and the discharge station;

a cooling means provided on the conveyor means between the washing and drying means and the discharge station;

a refilling station for refilling the wares;

wherein the conveyor means includes, at the sorter station, a first, input end, and a second, return end, provided vertically stacked and spaced apart relative to one another; and wherein the sorter station, conveyor means, washing and drying means, and cooling means are arranged such that baskets containing sets of wares are sequentially subject to washing, drying and cooling between the sorter and discharge stations.

20. An assembly as claimed in claim 19, wherein the return end is provided above, spaced apart from and substantially parallel with the input end.

21. An assembly as claimed in claim 20, wherein the sorter station includes a plurality of input locations for individual operators, including at least one input location on one side of the first input end of the conveyor means and at least one input location on the other side of the first input end of the conveyor means.

22. An assembly as claimed in claim 21, which includes two input locations on one side of the first input end of the conveyor means and two input locations on the other side of the first input end of the conveyor means, and wherein the system includes, at the discharge station, at least two refilling lines, for refilling the wares and reassembling the wares on trays.

23. An assembly as claimed in claim 22, wherein the two refilling lines are substantially similar.

24. An assembly as claimed in claim 22, wherein the conveyor means includes a return section extending from the discharge station to the return end of the conveyor means at the sorter station, and including an inclined section extending to the height of the return end, and wherein the return end is located below an uppermost point of the inclined section, whereby returned baskets can travel from the inclined section along the return end under gravity.

25. An assembly for washing soiled wares and providing the wares for refilling and reuse, the assembly comprising:

a sorter station, for receiving soiled wares, and for placing the soiled wares in baskets;

a discharge station for removing clean wares from the baskets and reassembling the wares into sets of wares;

a substantially continuous conveyor means extending between the input sorter station and the discharge station and back from the discharge station to the sorter station, for conveying the wares in the baskets;

a washing and drying means and a cooling means provided on the conveyor means between the sorter station and the discharge station, with the cooling means being located downstream from the washing and drying means; and a refilling station, at the discharge station, for refilling the wares;

wherein the conveyor means includes at least one corner extending through at least ninety degrees.

26. The system as claimed in claim 25, wherein the conveyor means includes one conveyor extending through the washing and drying means and through the cooling means, and another conveyor extending from the discharge station to the sorter station, and, at the discharge eRd station, a generally perpendicular junction between said one conveyor and said other conveyor, the other conveyor including a straight section extending through the discharge station, a substantially semicircular corner section and a corner section extending through substantially ninety degrees, thereby to minimize space requirements for the conveyor means.

27. A method of washing wares for food and filling the wares with food, the method comprising:

(a) receiving sets of soiled wares, each set comprising a plurality of wares intended to be used together for one individual;

(b) passing the wares through a washing and drying means, in which the wares are washed and dried;

(c) ensuring that the wares are cooled down to a temperature low enough to permit immediate refilling of the wares with food;

(d) dividing the wares based on food to be filled on the wares;

(e) reassembling the wares into sets; and (f) refilling the wares with food, whereby each set is ready for delivery to an individual;

wherein steps (a) to (c) are carried out substantially sequentially, and steps (a) to (f) are carried out substantially continuously.

28. The method as defined in claim 27 further comprising:

unloading sets of soiled wares from a plurality of carts in step (a), then passing the emptied carts through a washing and drying means, and then reloading the plurality of cleaned carts with wares filled with food.

29. The method as defined in claim 27 wherein step (a) is effected in an inbound, soil room, and step (b) is effected in a machine room, thereby to physically separate steps (a) and (b) from each other and from the remaining steps during execution in order to physically separate soiled wares from clean wares.

30. The method as defined in claim 29, wherein steps (d), (e) and (f), at least, are effected in a clean, assembly room, and wherein the inbound, soil room and the clean, assembly room are refrigerated.

31. A method as claimed in claim 27, including, in step (a) receiving sets of soiled wares at a sorter station, sorting wares into baskets and placing baskets onto a conveying means, conveying the baskets with the wares through the washing and drying means, and effecting steps (c), (d) and (e) sequentially along the conveying means, and, for step (e), removing the wares from the baskets and reassembling the wares into sets.

32. The method as defined in claim 31, including effecting steps (e) and (f) at a plurality of separate lines.

33. The method as defined in claim 32, including providing one line for galley and business wares and another line for economy class wares, at the sorting station filling each basket with just one of business class wares, galley wares and economy class wares, and for step (d), passing baskets containing galley and business wares to said one line and baskets containing economy class wares towards the other line.

34. The method as claimed in claim 33, including, for the economy class wares, to effect step (e), leaving the baskets on the conveying means and removing the economy class wares from the baskets and assembling economy class wares into sets on said other line.

35. The method as claimed in claim 32, including providing two substantially similar lines for reassembling and refilling substantially similar wares.

36. The method as claimed in claim 35, including providing a high through put sorter station including operator locations provided on either side of the sorter station.

37. The method as claimed in claim 36, including providing two operators on one side of the sorter station and two operators on the other side of the sorter station and providing the conveying means with a return end located vertically spaced relative to an input end of the conveying means.

38. The method as claimed in claim 32, including additionally and simultaneously refilling commissary carts with commissary goods at a separate commissary zone, where required cleaning commissary carts, and assembling all the filled carts together, for delivery to an aircraft.

* * * * *

UNITED STATES PATENT AND TRADEMARK OFFICE

CERTIFICATE OF CORRECTION

PATENT NO. : 6,684,607 B2
DATED : February 3, 2004
INVENTOR(S) : Martin B.H. Ng et al.

It is certified that error appears in the above-identified patent and that said Letters Patent is hereby corrected as shown below:

Column 15,
Lines 41, 45 and 47, add -- , -- after “first”;

Column 16,
Line 2, delete “input”; and
Line 18, delete “eRd”.

Signed and Sealed this

Sixth Day of July, 2004

JON W. DUDAS
*Acting Director of the United States Patent and Trademark Office*